United States Patent [19]

Ansems

[11] 4,452,414

[45] Jun. 5, 1984

[54] SUPPORTING DEVICE

[76] Inventor: Henricus J. Ansems, Spoorwegstraat 14, 6828 AS Arnhem, Netherlands

[21] Appl. No.: 376,677

[22] Filed: May 10, 1982

[51] Int. Cl.[3] ..... E04G 3/00

[52] U.S. Cl. ..... 248/278; 248/122

[58] Field of Search ..... 248/278, 104, 106, 276, 248/279, 282, 283, 122, 285, 662, 280.1, 274, 160; 285/272

[56] References Cited

U.S. PATENT DOCUMENTS

| | | | |
|---|---|---|---|
| 1,201,116 | 10/1916 | Vaughn | 285/168 |
| 1,299,899 | 4/1919 | Bessey et al. | 248/278 |
| 2,111,368 | 3/1938 | Kron | 248/274 X |
| 2,509,119 | 5/1950 | Warren | 248/168 |
| 2,557,507 | 6/1951 | Lang, Jr. | 287/14 |
| 2,680,588 | 6/1954 | Wright | 248/231.4 |
| 3,266,059 | 8/1966 | Stelle | 3/12.3 |

FOREIGN PATENT DOCUMENTS

| | | |
|---|---|---|
| 483690 | 6/1948 | Belgium . |
| 1909716 | 9/1969 | Fed. Rep. of Germany . |
| 2840314 | 3/1980 | Fed. Rep. of Germany . |
| 1105984 | 12/1955 | France . |
| 2184263 | 11/1973 | France . |
| 2363021 | 3/1978 | France . |

*Primary Examiner*—J. Franklin Foss

*Attorney, Agent, or Firm*—Wood, Dalton, Phillips, Mason & Rowe

[57] ABSTRACT

The invention relates to a supporting member comprising at least two relatively turnable parts, said two parts accommodating a biassed, helically wound tensile spring fixed at least at two spots, whereby the supporting member comprises several curved or sharply bent parts which can be turned with respect to one another, while in the spring such a torsional tension is produced that the parts will remain in any desired, normal position of use relative to one another under the influence of said torsional stress and the friction prevailing between the relatively turnable parts.

2 Claims, 1 Drawing Figure

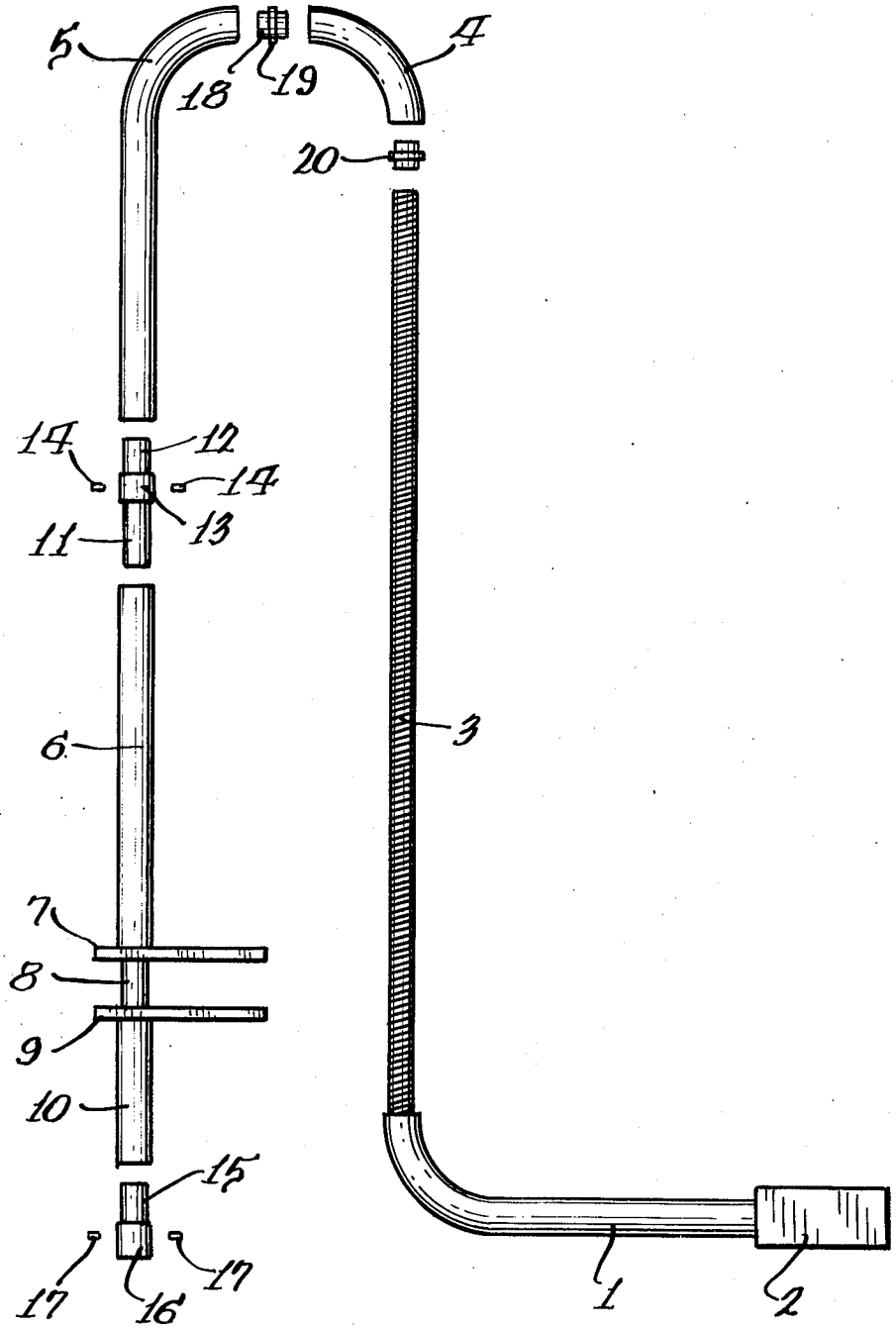
5
18
19
4
20
14
12
14
13
11
6
3
7
8
9
10
15
17
16
17
1
2

SUPPORTING DEVICE

The invention relates to a supporting device comprising at least two relatively rotatable parts.

The invention has for its object to provide a supporting device of the kind set forth, in which the two parts can be readily turned with respect to one another and can maintain a fixed position relative to one another without the use of locking members.

According to the invention this can be achieved by arranging in the two parts a biassed, helically wound tensile spring fixed at least at two points.

By using this construction a simple structure of the supporting device can be obtained, in which the relatively rotatable parts will remain in a desired position by the friction forces produced between said parts and/or by the torsional force produced in the helical spring.

The FIGURE is an exploded elevational view of the supporting member.

The invention will now be described more fully with reference to the accompanying sketch showing some component parts of an embodiment of a supporting constructing at a distance from one another.

In the embodiment shown the supporting sonstruction comprises a tubular part 1 having a straight portion and a quarter bend. To the right-hand end of said tubular part can be fastened a member to be supported, for example, a lamp holder 2.

In the tubular part 1 is fixed the end of a helically wound tensile spring 3.

The supporting device furthermore comprises a tubular part 4 formed by a quarter bend and a tubular part 5 having a straight portion and an adjoined quarter bend. The supporting device is furthermore provided with a straight, tubular part 6, to the lower end of which is secured a supporting plate 7. In the tubing 6 is slidable in its direction of length a tubing 8 associated with the supporting member and to the lower end of the tubing 8 is fastened a supporting plate 9. Beneath the supporting plate 9 is fastened a tubing 10 so that the centre line of this tubing 10 coincides with the centre line of the tubing 8.

The lower end of the tubing 5 can be coupled with the tubing 6 with the aid of a tie piece 11 formed by a tubing 12 provided between its ends with a thickened, annular portion 13. This annular portion 13 has two tapped holes for receiving guard screws 14.

Into the lower end of the tubing 10 can be inserted a coupling piece 15, which is provided at its lower end with a thickened, annular portion 16 also having two tapped holes for receiving guard screws 17. Between the ends of the tubing 4 and the tubing 5 to be joined to one another is arranged a coupling piece 18 having nears its middle a thickened, annular portion 19 so that the ends of said coupling piece can be inserted into the ends of the tubings 5 and 4, the annular portion thus being locked between the ends of the tubings 4 and 5.

A similar coupling piece 20 is used for the disposition on the ends of the tubings 1 and 4 to be joined to one another.

Whe mounting the supporting member described above first the coupling piece 20 is slipped onto the spring, then the tubing 4, the coupling piece 18, the tubing 5 and the coupling piece 11 in a manner such that the various parts of the supporting member, through which the spring 3 is slid, are rigidly joined to one another. Subsequently the sping 3 is firmly stretched and then fixed in the coupling piece 11 with the aid of the guard screws 14. It will be obvious that the various parts 1, 20, 4, 18, 5 and 11 are firmly drawn to one another by the spring.

The remaining part of the spring is passed through the parts 6, 8 and 10 of the supporting member, said remaining part of the spring being also biassed and finally fixed to the coupling piece 15 with the aid of the guard screws 17. It will be obvious that as a result the supporting plate 9 tends to move towards the supporting plate 7 by the action of the spring tension produced in the portion of the tensile spring located between the guard screws 14 and the guard screws 17. The arrangement may be such that during mounting and generating the tensile force in the last-mentioned portion of the tensile spring 3 the plates 7 and 9 come into contact with one another, whereas an alternative resides in that with the aid of stop members (not shown) it can be ensured that the supporting plates 7 and 9 are spaced apart by a minimum distance.

By correct choice of the dimensions of the spring and, as the case may be, by generating a given torsional stress in the spring by an initial turn of the various parts relative to one another after the spring is fastened, a sufficiently high friction force can be produced between the various adjoining parts of the supporting member and an adequate torsional force can be generated in the spring to ensure that subsequent to a turn of one or more of the parts 1, 4, 5 and 6 relative to one another said parts remain in the set position without the need for additional locking members or the like. Moreover, the supporting member can be clamped to a table top or the like with the aid of the supporting plates 7 and 9.

By building up the supporting member with the use of curved or sharply bent parts a great number of different positions can be set for the supported member, for example, a lamp holder 2 or the like.

Instead of using a single spring fixed at several spots a plurality of registering springs may, as an alternative, be employed.

The figures used in the claims are only meant to explain more clearly the intention of the invention and are not supposed to be any restriction concerning the interpretation of the invention.

I claim:

1. A supporting member comprising, a plurality of tubular parts at least some of which are curved and which can be turned relative to each other, a plurality of tubular coupling members for interconnecting said tubular parts, each coupling member having a collar of a larger diameter intermediate its ends whereby a coupling member can have its ends positioned within adjacent ends of two tubular parts with said adjacent ends abutting said collar, and a single biased helically wound tensile spring extending through said tubular parts and tubular coupling members and secured under tension at its opposite ends in two of said tubular parts to produce friction between said coupling member collar and adjacent ends of the tubular parts whereby with torsional tension of said spring and friction between the coupling members and tubular parts said relatively rotatable tubular parts will remain in any desired normal position of use.

2. A supporting member as defined in claim 1 and having a pair of supporting plates adjacent an end of the supporting member and connected to a pair of said tubular parts for movement toward and away from each other, the connection of said tensile spring at one of its ends being to one of said pair of tubular parts, and means operatively connecting said tensile spring intermediate its ends to the other of said pair of tubular parts whereby a length of said tensile spring urges said supporting plates toward each other.

* * * * *